US010669820B2

(12) United States Patent
Smith et al.

(10) Patent No.: US 10,669,820 B2
(45) Date of Patent: Jun. 2, 2020

(54) FRAC AND GRAVEL PACKING SYSTEM HAVING RETURN PATH AND METHOD

(71) Applicants: James Smith, Manvel, TX (US); Adam McGuire, Houston, TX (US); Wilfred Provost, Saint Martinville, LA (US); Hector Mireles, Spring, TX (US); Andrew Cayson, Cypress, TX (US)

(72) Inventors: James Smith, Manvel, TX (US); Adam McGuire, Houston, TX (US); Wilfred Provost, Saint Martinville, LA (US); Hector Mireles, Spring, TX (US); Andrew Cayson, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 151 days.

(21) Appl. No.: 15/419,408

(22) Filed: Jan. 30, 2017

(65) Prior Publication Data

US 2018/0094508 A1 Apr. 5, 2018

Related U.S. Application Data

(60) Provisional application No. 62/402,697, filed on Sep. 30, 2016.

(51) Int. Cl.
*E21B 43/04* (2006.01)
*E21B 43/26* (2006.01)

(52) U.S. Cl.
CPC ..... *E21B 43/04* (2013.01); *E21B 43/26* (2013.01)

(58) Field of Classification Search
CPC ..... E21B 43/04; E21B 43/26; E21B 34/10
See application file for complete search history.

(56) References Cited

U.S. PATENT DOCUMENTS 6,494,256 B1 * 12/2002 Achee, Jr. ..... E21B 34/14 166/227
6,702,020 B2 3/2004 Zachman et al.
9,447,661 B2 * 9/2016 Broussard ..... E21B 33/124
2003/0192694 A1 10/2003 Zachman et al.
2011/0067862 A1 3/2011 Clem et al.
(Continued)

OTHER PUBLICATIONS

International Search Report for International Application No. PCT/US2017/047967; dated Nov. 30, 2017; 4 pages.
(Continued)

*Primary Examiner* — Robert E Fuller
*Assistant Examiner* — Lamia Quaim
(74) *Attorney, Agent, or Firm* — Cantor Colburn LLP

(57) ABSTRACT

A frac and gravel packing system including a tubular having a longitudinal axis, a wall defining an interior flowbore, a radial frac port and a radial production port extending through the wall in a first zone of an annular region surrounding the tubular; a screen surrounding the production port, the frac port not covered by the screen; a sleeve system including a sleeve longitudinally shiftable with respect to the longitudinal axis of the tubular, the sleeve configured to cover the frac port in a first position of the sleeve and uncover the frac port in a second position of the sleeve; and, a return path arranged to permit return fluid from a fracturing operation to exit the first zone of the annular region, wherein the return fluid passes through the screen prior to accessing the return path.

20 Claims, 9 Drawing Sheets

(56) References Cited

U.S. PATENT DOCUMENTS

| | | | | |
|---|---|---|---|---|
| 2011/0132613 | A1 | 6/2011 | Xu | |
| 2013/0008652 | A1 | 1/2013 | Broussard et al. | |
| 2014/0014347 | A1 | 1/2014 | Adam et al. | |
| 2014/0116693 | A1* | 5/2014 | Broussard | E21B 34/06 166/278 |
| 2015/0075780 | A1* | 3/2015 | Richards | E21B 17/04 166/250.1 |
| 2015/0211334 | A1 | 7/2015 | Richards | |
| 2016/0102525 | A1* | 4/2016 | Ross | E21B 23/06 166/250.01 |

OTHER PUBLICATIONS

Written Opinion of the International Search Report for International Application No. PCT/US2017/047967; dated Nov. 30, 2017; 8 pages.

* cited by examiner

FRAC AND GRAVEL PACKING SYSTEM HAVING RETURN PATH AND METHOD

CROSS REFERENCE TO RELATED APPLICATIONS

This application claims the benefit of an earlier filing date from U.S. Provisional Application Ser. No. 62/402,697 filed Sep. 30, 2016, the entire disclosure of which is incorporated herein by reference.

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

To increase the production from a borehole, the production zone can be fractured to allow the formation fluids to flow more freely from the formation to the borehole. The fracturing operation includes pumping fracturing fluids including proppants at high pressure towards the formation to form and retain formation fractures. A conventional fracturing system passes pressurized fracturing fluid through a tubular string that extends downhole through the borehole that traverses the zones to be fractured. The string may include valves that are opened to allow for the fracturing fluid to be directed towards a targeted zone. To remotely open the valve from the surface, a ball is dropped into the string and lands on a ball seat associated with a particular valve to block fluid flow through the string downhole of the ball and consequently build up pressure uphole of the ball which forces a sleeve to move in a downhole direction thus opening a frac port in the wall of the string. When multiple zones are involved, the ball seats are of varying sizes with a downhole-most seat being the smallest and an uphole-most seat being the largest, such that balls of increasing diameter are sequentially dropped into the string to sequentially open the valves from the downhole end to an uphole end. Thus, the zones of the borehole are fractured in a "bottom-up" approach by starting with fracturing a downhole-most zone and working upwards towards an uphole-most zone.

Because hydrocarbon production wells are often drilled into unconsolidated formations, sand and fines from those formations will tend to enter the production tubing along with the produced fluids. To prevent this, a fracturing and gravel packing treatment can be performed, commonly referred to as a "frac pack," within the wellbore prior to production.

A conventional frac pack system includes a screen assembly that is placed in the wellbore near the unconsolidated formation. The screen assembly radially surrounds a wash pipe, and both the screen assembly and wash pipe are connected, at their upper ends, to a service tool. The usual service tool includes a production packer and a cross-over tool, which are connected to a work string that extends downwardly from the surface. The work string is used to position the screen assembly in the wellbore. Packers provide fluid sealing. The frac pack system can be placed into a "squeeze" configuration, wherein no fluids return to the surface. In this configuration, fracturing fluid is passed through the cross-over tool, into the annulus and then into the formation. Alternately, the frac pack system can be placed into a "circulation" position to allow flow through the wash pipe back to the surface. Gravel packing slurry is then flowed in through the cross-over tool to gravel pack the annulus around the screen assembly. The gravel collects around the screen to form the gravel pack. The gravel allows flow of produced fluids there through and into the screen while blocking the flow of particulates produced with the formation fluids. When gravel packing is completed, the service tool is detached from the screen assembly and withdrawn from the wellbore, leaving the gravel packed screen assembly and packer in place.

The art would be receptive to improvements in frac and gravel packing systems and methods.

BRIEF DESCRIPTION

A frac and gravel packing system including a tubular having a longitudinal axis, a wall defining an interior flowbore, a radial frac port and a radial production port extending through the wall in a first zone of an annular region surrounding the tubular; a screen surrounding the production port, the frac port not covered by the screen; a sleeve system including a sleeve longitudinally shiftable with respect to the longitudinal axis of the tubular, the sleeve configured to cover the frac port in a first position of the sleeve and uncover the frac port in a second position of the sleeve; and, a return path arranged to permit return fluid from a fracturing operation to exit the first zone of the annular region, wherein the return fluid passes through the screen prior to accessing the return path.

A method of fracturing a formation and gravel packing a screen, the method including: actuating a sleeve to reveal a radial frac port in a tubular; revealing a radial production port in the tubular; fracturing a formation in a first zone through the frac port with fracturing fluid; packing a screen surrounding the production port with particulates from the fracturing fluid and the formation; passing return fluids from the fracturing fluid through the screen; and, sending the return fluids through a return path to a location uphole or downhole of the first zone.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
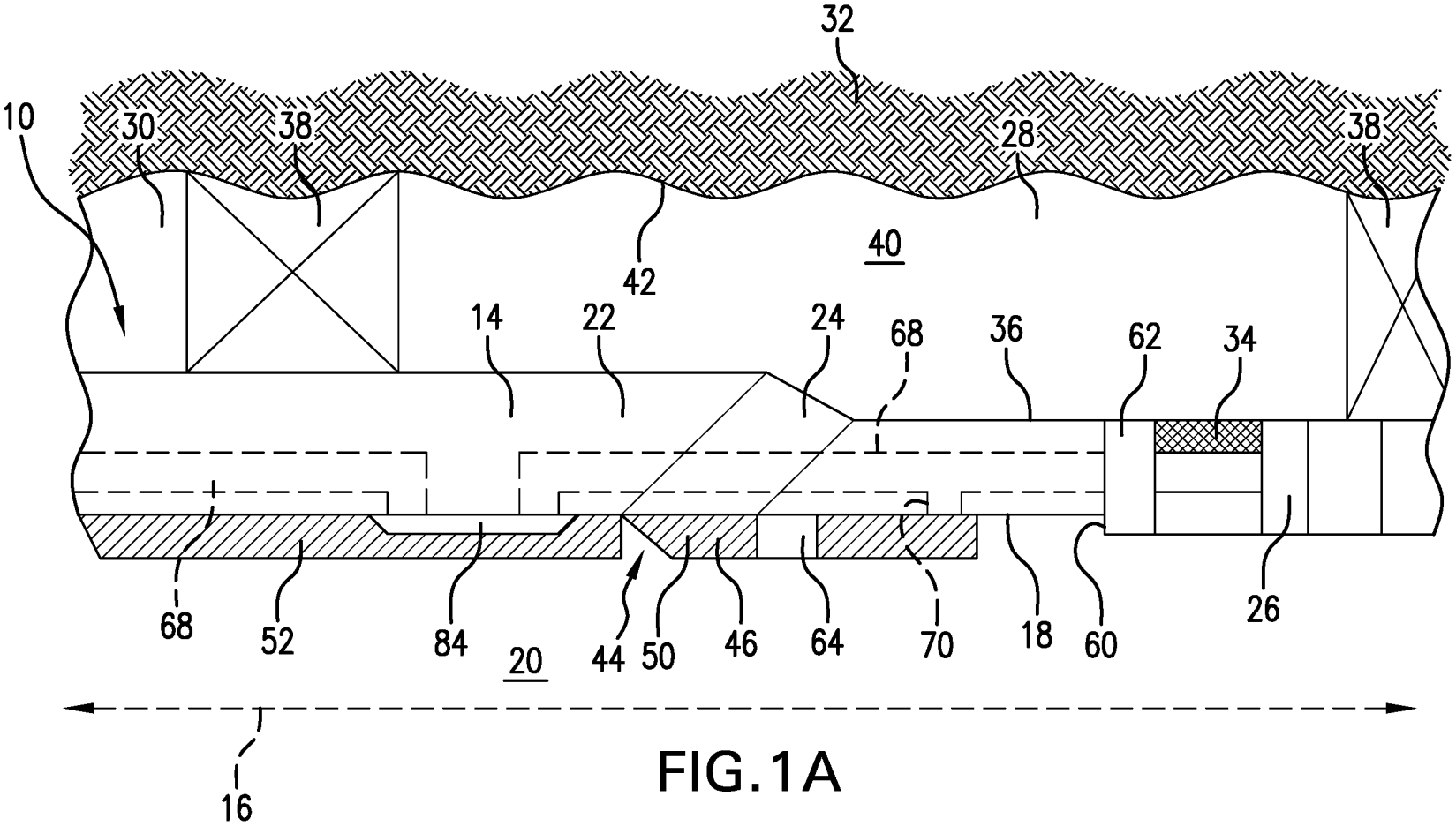
FIGS. 1A-1D depict schematic sectional and cross-sectional views of an embodiment of a frac and gravel packing system in which return fluids are directed to surface.

A detailed description of one or more embodiments of the disclosed apparatus and method are presented herein by way of exemplification and not limitation with reference to the Figures.

With reference to FIGS. 1A-1D, one embodiment of a frac and gravel packing system 10 with integrated return path is depicted. The system 10 includes a tubular 14 having a longitudinal axis 16 and an interior surface 18 of the tubular 14 forms a flowbore 20. The tubular 14 within this system 10 refers to any number of extensions, pipe segments, and connections to support the features of the system 10. The tubular 14 further includes a wall 22 having at least one radial frac port 24 and at least one radial production port 26 in a zone 28 within a borehole 30 that extends through a formation 32. The production port 26 is surrounded by a screen 34. For example, the screen 34 may concentrically surround the tubular 14 in the area of the production port 26, however the screen 34 does not surround the frac port 24. An exterior surface 36 of the tubular 14 may be sealed within the borehole 30 by one or more packers 38 after the system 10 is run in. The zone 28 may be isolated from adjacent zones by packers 38 positioned uphole and downhole of the zone 28. The tubular 14 may include additional frac ports 24 and production ports 26 in each zone 28. An annular region 40 is created between the exterior surface 36 of the tubular 14 and a formation wall 42 (or alternatively a casing). The system 10 further includes a sleeve system 44 that is longitudinally shiftable with respect to the longitudinal axis 16 of the tubular 14. In a run-in condition, as well as a closed condition shown in FIG. 1A, a first sleeve 46 of the sleeve system 44 fluidically blocks the frac port 24 from permitting fluidic communication between the flowbore 20 and the annular region 40. The first sleeve 46 is positioned within the flowbore 20 of the tubular 14 and includes at least one aperture 64 which is misaligned with the frac port 24 in the run-in condition. That is, the first sleeve 46 includes a non-apertured portion 50 that blocks the frac port 24 in the run-in condition. Also, the first sleeve 46 may be shear pinned or otherwise releasably secured within the tubular 14 so that the first sleeve 46 is not prematurely shifted. The sleeve system 44 further includes a second sleeve 52 that may also be shear pinned or otherwise releasably secured within the tubular 14 so that the second sleeve 52 is not prematurely shifted.

Figure 1B:
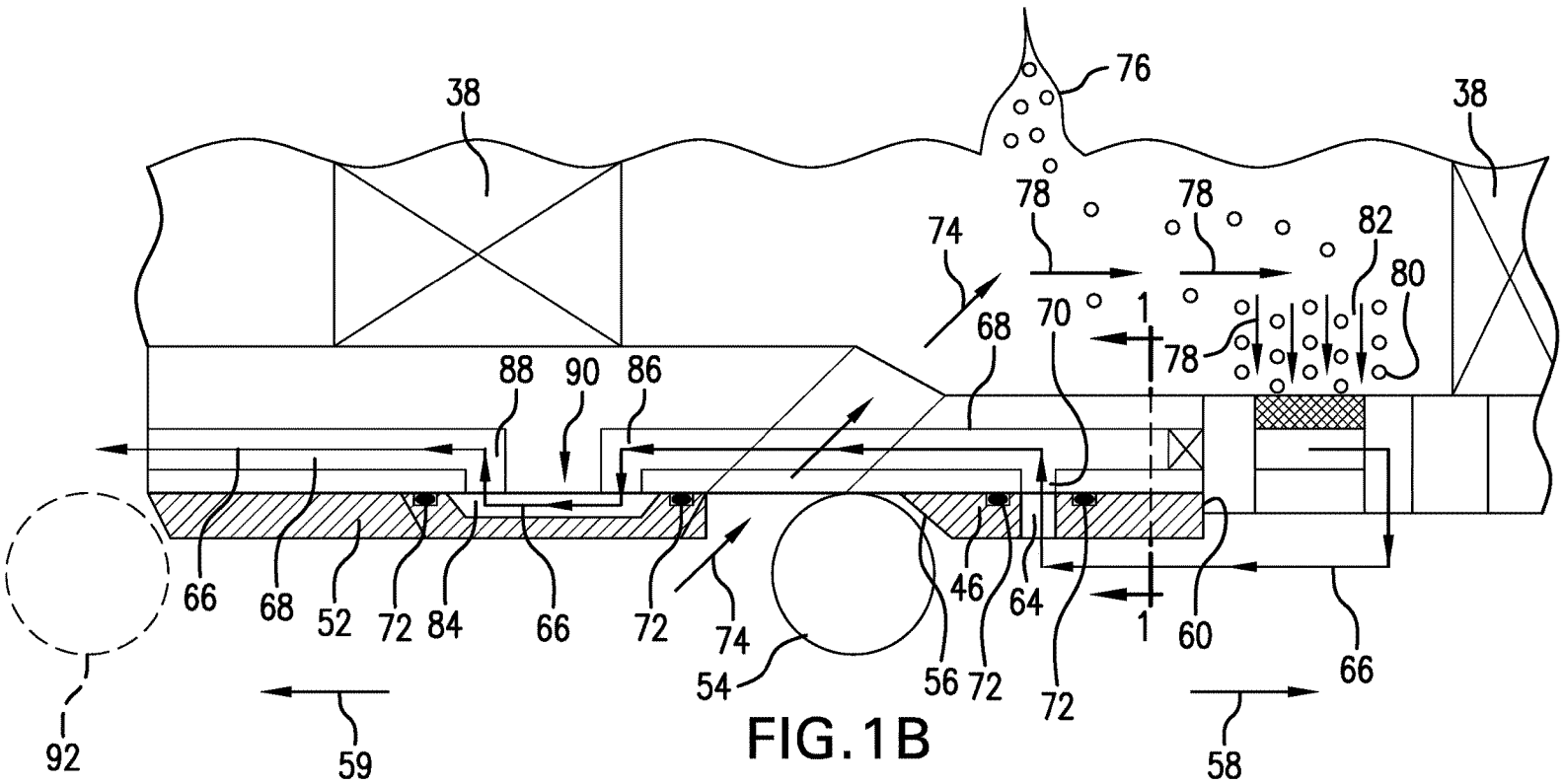

When the system 10 is positioned and secured within the borehole 30, and the formation 32 within the zone 28 is ready to be fractured, the first sleeve 46 is moved longitudinally within the tubular 14 to reveal the frac port 24, as shown in FIG. 1B. In one embodiment, movement of the first sleeve 46 is accomplished by dropping a first plug 54, such as a ball, onto a plug seat 56, such as a ball seat, formed on the first sleeve 46. The plug 54, the first sleeve 46, and the second sleeve 52 may be sized such that the first plug 54 passes through the second sleeve 52 but cannot pass through the first sleeve 46, and lands on the smaller inner diameter of the plug seat 56 of the first sleeve 46. After the plug 54 is situated on the plug seat 56, pressure within the flowbore 20 may be increased to force the plug 54 and the first sleeve 46 in the downhole direction 58, shearing the shear pin the secures the first sleeve 46 to the tubular 14, or otherwise forcing the first sleeve 46 away from its initial position. The pressure used to move the first sleeve 46 may be frac pressure. The interior surface 18 of the tubular 14 may include a shoulder 60 to limit the distance in which the first sleeve 46 moves longitudinally when the downhole end of the first sleeve 46 abuts the shoulder 60. Also, when the first sleeve 46 shifts from the initial run-in position to the open position, the frac port 24 is revealed to the flowbore 20. A production valve 62 (FIG. 1A) may be used to open the production port 26 either prior to opening the frac port 24, at substantially the same tune as opening the frac port 24, or shortly after opening the frac port 24. Alternatively, the production port 26 may be filled with a dissolvable material that dissolves in response to wellbore fluids or injected chemicals prior to commencement of a frac and gravel packing operation. Alternatively, as will be similarly described below with respect to FIGS. 2A-2D and 4, the first sleeve 46 may include a non-apertured portion that covers the production port 26 in the run-in condition and a production port aperture that is alignable with the production port 26 to reveal the production port 26 to the flowbore 20 during an operating condition.

The first sleeve 46 further includes return path aperture 64 that forms part of a return path 66 of the system 10. The return path 66 also includes a longitudinal pathway 68, and the return path aperture 64 is alignable with a radial access 70 to connect with the longitudinal pathway 68. An O-ring seal 72 may be positioned on each side of the radial access 70. Thus, the longitudinal pathway 68 is made accessible to the flowbore 20 at substantially the same time the frac port 24 is opened. In an embodiment where the first sleeve 46 includes a production aperture in addition to the return path aperture 64, then the frac port 24, the radial access 70, and the production port 26 can all be exposed at substantially the same time during the one operation of moving the first sleeve 46 from the closed position to the open position.

When frac pressure is used to move the first sleeve 46 to the open position shown in FIG. 1B, the formation 32 is fractured using the frac fluid 74 that passes through the opened frac port 24. As the frac fluid 74 is used to fracture the formation 32, some of the proppant from the frac fluid 74 will wedge into the fractures 76. Fluid returning from the formation 32, hereinafter referred to as return fluid 78, will enter the annular region 40 and pass through the screen 34 and the production port 26 and into the flowbore 20. Sand and gravel 80 from the fractured formation 32 as well as from the frac fluid 74 that is returned from the formation 32 will be blocked from passing through the screen 34. Blocked sand and gravel 80 will form a gravel pack on the screen 34 while passing the return fluid 78 therethrough. Thus, a gravel pack 82 is formed in the zone 28 at the screen 34.

The system 10 includes one embodiment of directing the return fluid 78 to surface in uphole direction 59. The return path 66 may, in one embodiment, pass through the packers, extensions, and concentric screens of the system 10. Since the flowbore 20 is blocked by the plug 54, the return fluid 78 will naturally exit into the longitudinal pathway 68 of the return path 66 via the aligned radial access 70 and return path aperture 64. The longitudinal pathway 68 may be formed through the wall 22 of the tubular 14, and past the second sleeve 52. The pathway 68 may, in one embodiment, be formed by gun drills. In one embodiment, the second sleeve 52 includes a connecting portion 84 of the return path 66, such as an indent, that fluidically connects a downhole portion 86 of the pathway 68 with an uphole portion 88 of the pathway 68 when the second sleeve 52 is in the un-shifted condition shown in FIG. 1B. The downhole portion 86 and uphole portion 88 may be separated in the tubular 14 by an interruption 90, such as a protrusion of the tubular wall 22, which the second sleeve 52 straddles in the un-shifted condition. O-ring seals 72 may protect the return path 66 between the second sleeve 52 and the tubular 14 to seal the flow through the return path 66. Thus, return fluid 78, which enters the flowbore 20 through the production port 26, is returned to surface using the return path 66. The return path 66 in this embodiment may include, in part, the screen 34, the production port 26, the flowbore 20, the return path aperture 64, the radial access 70, the downhole and uphole portions 86, 88 of the longitudinal pathway 68 and the connecting portion 84 of the second sleeve 52.

Figure 1C:
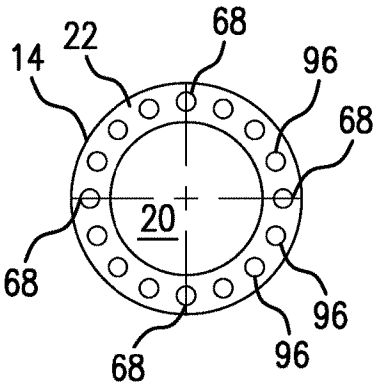

FIG. 1C shows a cross-section of the tubular 14. In one embodiment, the return path 66 includes four pathways 68 located at 90 degrees from each other for passing return fluids 78 to surface. The other passages 96 shown through the wall of the tubular 14 may be used for production purposes. Directing the return fluids 78 to the surface provides the advantages of being able to analyze the fluid content of the return fluids 78 as well as assess and monitor the formation pressure by analysis of the return fluids 78.

Figure 1D:
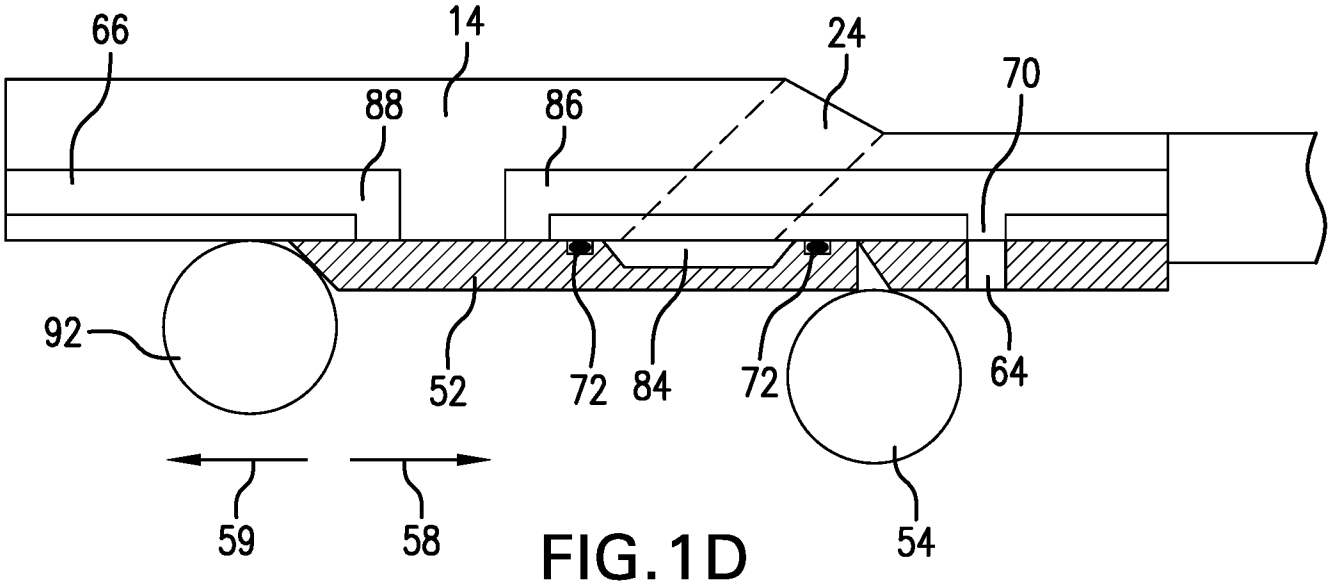

After the completion of the fracturing and gravel packing operations, upon the creation of fractures 76 and a gravel pack 82, and after the return fluid 78 has passed through the return path 66, the frac port 24 can be closed by longitudinally shifting the second sleeve 52 to the closed position, as shown in FIG. 1D. In one embodiment, closure of the second sleeve 52 may be accomplished by landing a second plug 92 larger than the first plug 54 onto a plug seat 94 of the second sleeve 52, and using pressure within the flowbore 20 to force the second sleeve 52 into a position radially interior to the frac port 24, thus fluidically blocking the frac port 24 from the flowbore 20. The second sleeve 52 may move the O-ring seals 72 carried thereon to surround the frac port 24. The connecting portion 84 of the second sleeve 52 is misaligned with the uphole and downhole portions 86, 88 of the longitudinal pathway 68. Thus, the return path 66 is blocked past the first zone 28. This occurs so that when a second zone, uphole of the first zone 28, is fractured and gravel packed, the return fluids from the second zone cannot travel downhole to the first zone 28. Instead, with nowhere else to go, return fluids from the second zone are forced in the uphole direction 59 through the return path 66 that extends through the second zone. Thus, in addition to closing the frac port 24, the second sleeve 52 can additionally serve to sever return fluid communication between adjacent zones.

Thus, FIGS. 1A-1D illustrate one embodiment of a ball drop system that utilizes feed through packers, frac sleeves and screens to allow for return flow. This enables a gravel pack or frac pack operation without the need for washpipe or a conventional crossover tool. This system 10 would allow for multiple zones to be treated quickly and effectively while also minimizing the risk of getting a tool stuck. A method of employing the system 10 may include attaching a running tool to a fluid loss valve and/or other downhole valve at the top of the completion. All packers, frac sleeves, and screens would have flow areas to allow for returns. A ball, such as plug 54, would be pumped down and land on the lower most zone exposing a frac port 24 to frac out of. An access 70 to return path 66 is exposed downhole of the plug 54, which allows communication (returns) from the screen 34 up through all of the zones to the surface. Once fracking is complete, a larger plug 92 is dropped to close off the frac port 24. Dropping the larger plug 92 also closes off the return path 66 so that the upper zones cannot communicate with the lower zones. The system 10 thus allows fluids to move to the bottom of each zone and carry the gravel and sand to the bottom of each zone, substantially packing the entire zone to form gravel pack 82, and when the fracking and gravel packing is completed, a larger ball can be dropped closing the frac port 24. The process can then continue, moving up the string of the system 10, from zone to zone to complete packing for all of the zones. During a production phase, in which produced fluids such as oil are produced through the screen 34 and flowbore 20, the production port 26 may include an inflow control device to shut the flow of produced fluids if it is determined that undesirable fluids such as water are being produced, or if production from only certain zones is desired.

Figure 2A:
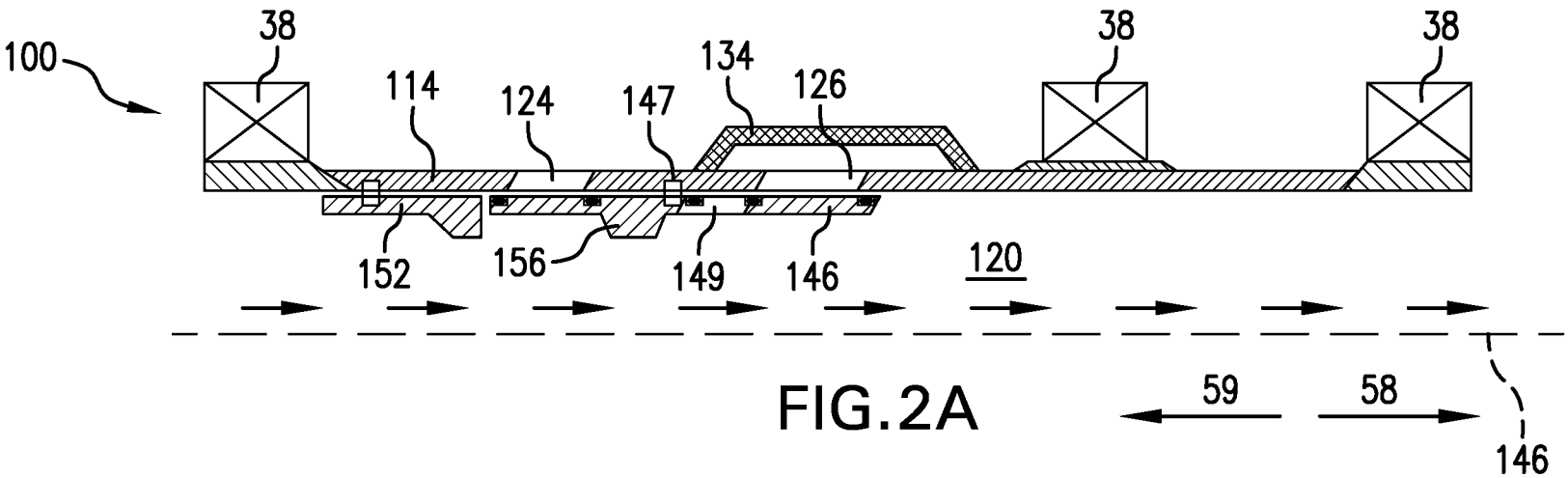
FIGS. 2A-2D depict schematic sectional views of an embodiment of a frac and gravel packing system in which return fluids are directed to a downhole location.
Figure 2B:
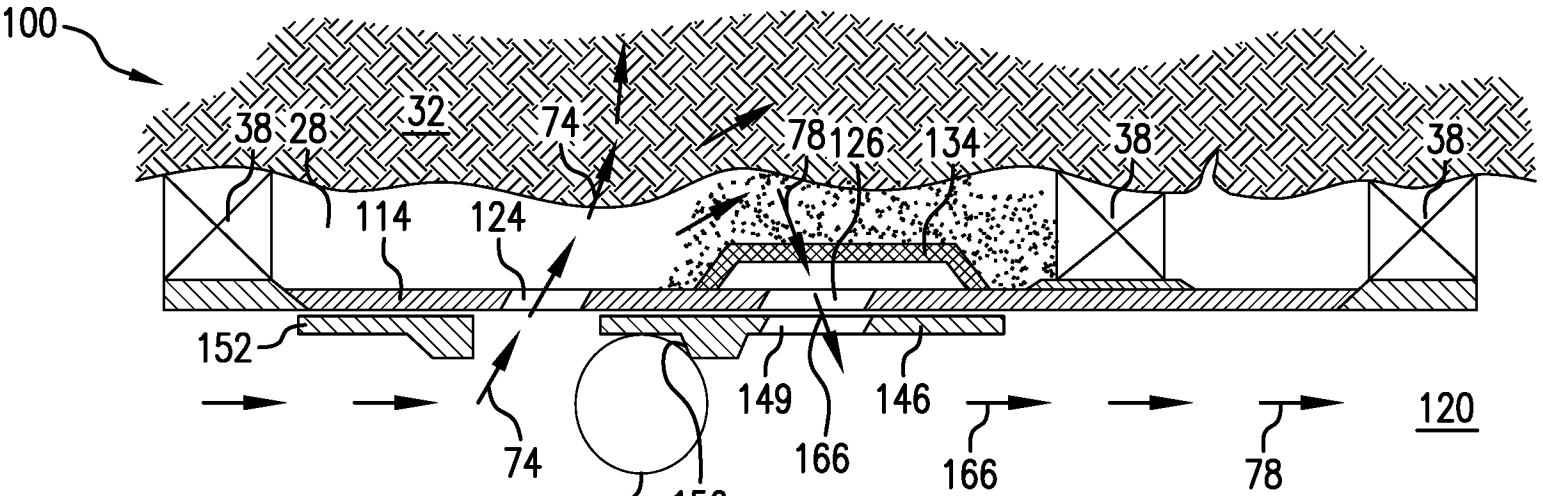
Figure 2C:
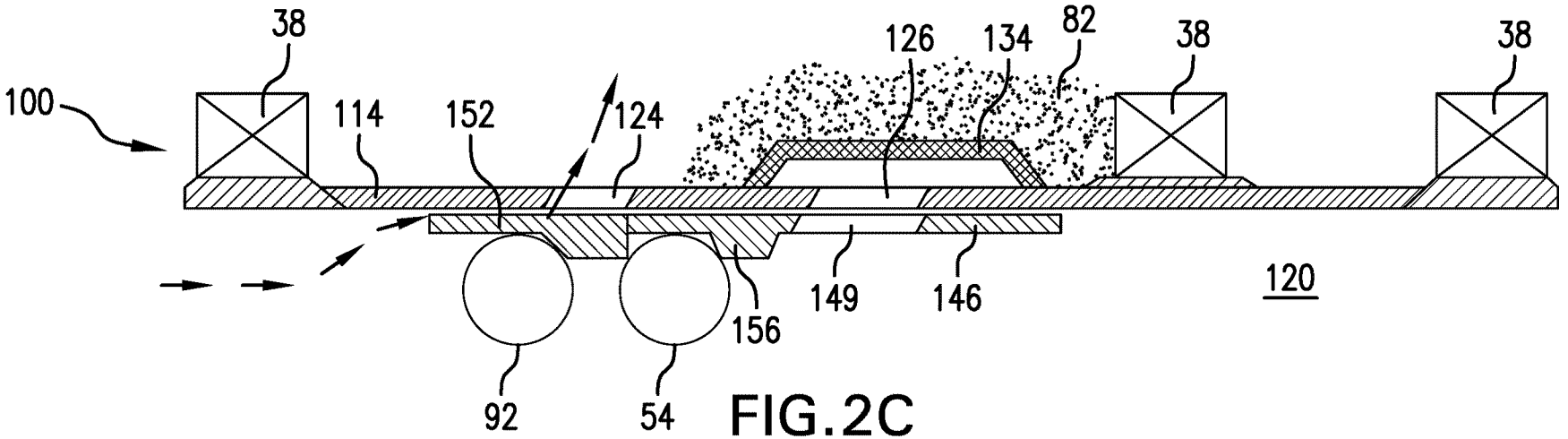
Figure 2D:
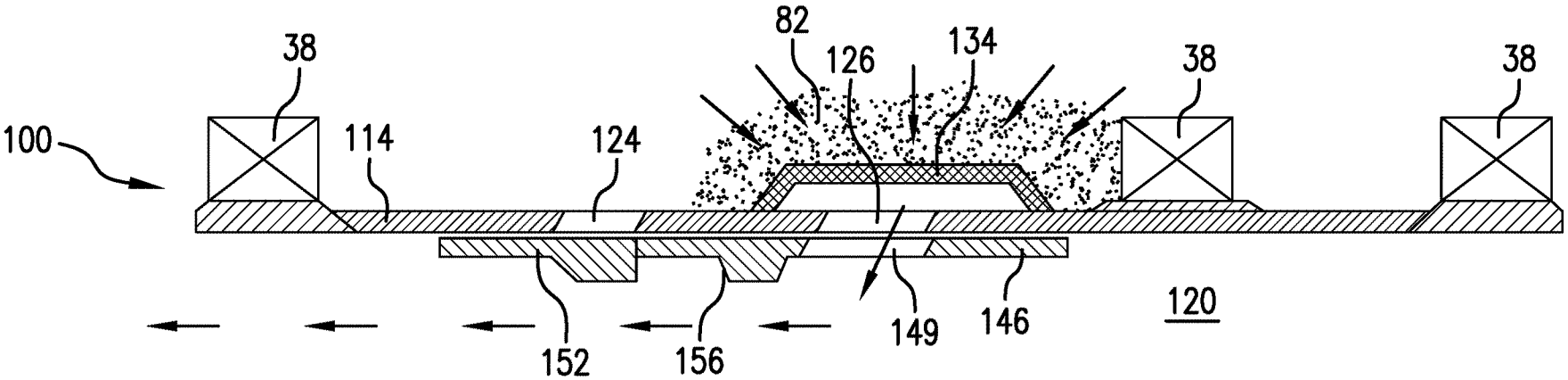

Turning now to FIGS. 24-2D, another embodiment of a frac and gravel packing system 100 is shown which can also frac and substantially simultaneously gravel pack the screen 134 while providing a return path 166 for return fluids 78. One difference in this embodiment from the system 10 shown in FIGS. 1A-1D is that the return fluids 78 are directed in the downhole direction 58 instead of the uphole direction 59. FIG. 2A shows a closed condition in which the first sleeve 146 blocks both the frac port 124 and the production port 126. FIG. 2B shows a plug 54 landing on the plug seat 156 of the first sleeve 146. Frac pressure is applied to the flowbore 120 of the tubular 114 which applies pressure to the plug 54, shearing the shear screw 147 and moving the first sleeve 146 to an open position, which opens both the frac port 124 and the production port 126. The production port 126 may be opened by aligning the production port aperture 149 in the first sleeve 146 with the production port 126. The frac fluids 74 are directed towards the formation 32. Some of the return fluid 78 passes through the screen 134 and the aligned production port 126 and aperture 149. With the flowbore 120 blocked by the plug 54, the return fluids 78 are forced in the downhole direction 58.

FIG. 2C shows closure of the second sleeve 152 using a second plug 92. In one embodiment, the second sleeve 152 may include a sand barrier but provide a small leak for clean fluid to pass through the frac port 124 and complete the gravel pack 82. The plugs 54, 92 may be removed, such as through disintegration, dissolving the plugs 54, 92, or by dissolving or otherwise removing or displacing a portion of the sleeves 146, 152 to allow the plugs 54, 92 to pass by. Once the plugs 54, 92 are gone, produced fluids from the annular region 40 can pass through the gravel pack 82, through the screen 134, through the aligned production port 126 and aperture 149, into the flow/bore 120 and up the tubular 114 in the uphole direction 59 as shown in FIG. 2D.

With respect to FIGS. 2A-2D, rather than sending return fluid 78 to surface, return fluid 78 is sent in the downhole direction 58 into one of the lower zones downhole of the first zone 28 or a dump zone. The first sleeve 146 is downhole of the second sleeve 152 and covers both the frac port 124 and the production port 126 in the closed condition. Then, when the first plug 54 is dropped, the sleeve 146 is shifted down and opens the frac port 124 and the production port 126, with the plug 54 disposed between the two ports 124, 126. Frac fluid 74 is pumped down the flowbore 120 to frac the formation 32. Sand, proppant, and gravel from the frac operation will eventually cover and gravel pack around the screen 134 while return fluid 78 will pass through the screen 134 and enter the flowbore 120 through the production port 126 and production port aperture 149. The length of the screen 134 is selected to ensure that the sleeve 146 that covers both the frac port 124 and the production port 126 can shift longitudinally relative to the longitudinal axis 16. That is, if the screen is too long, then the sleeve may have to have a length that may not properly shift longitudinally if there is a bend in the tubular string of the system within a curved borehole 30.

Figure 3A:
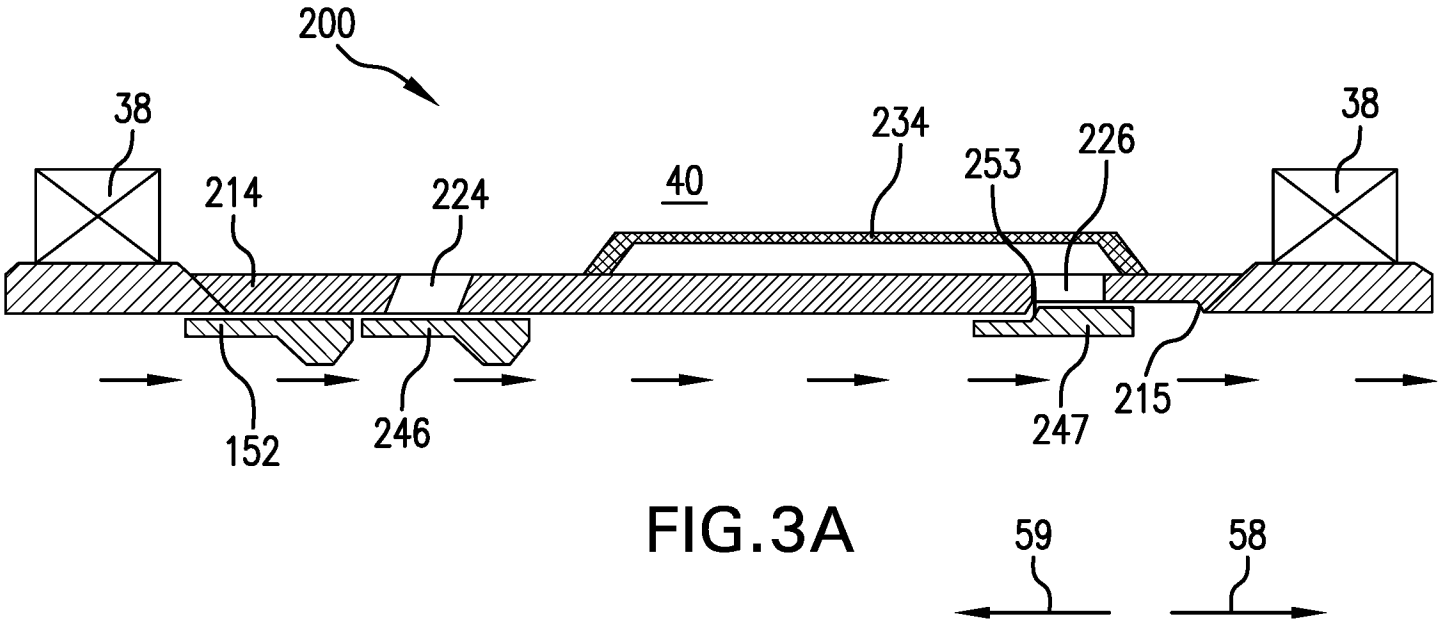
FIGS. 3A-3B depict schematic sectional views of another embodiment of a frac and gravel packing system in which return fluids are directed to a downhole location.
Figure 3B:
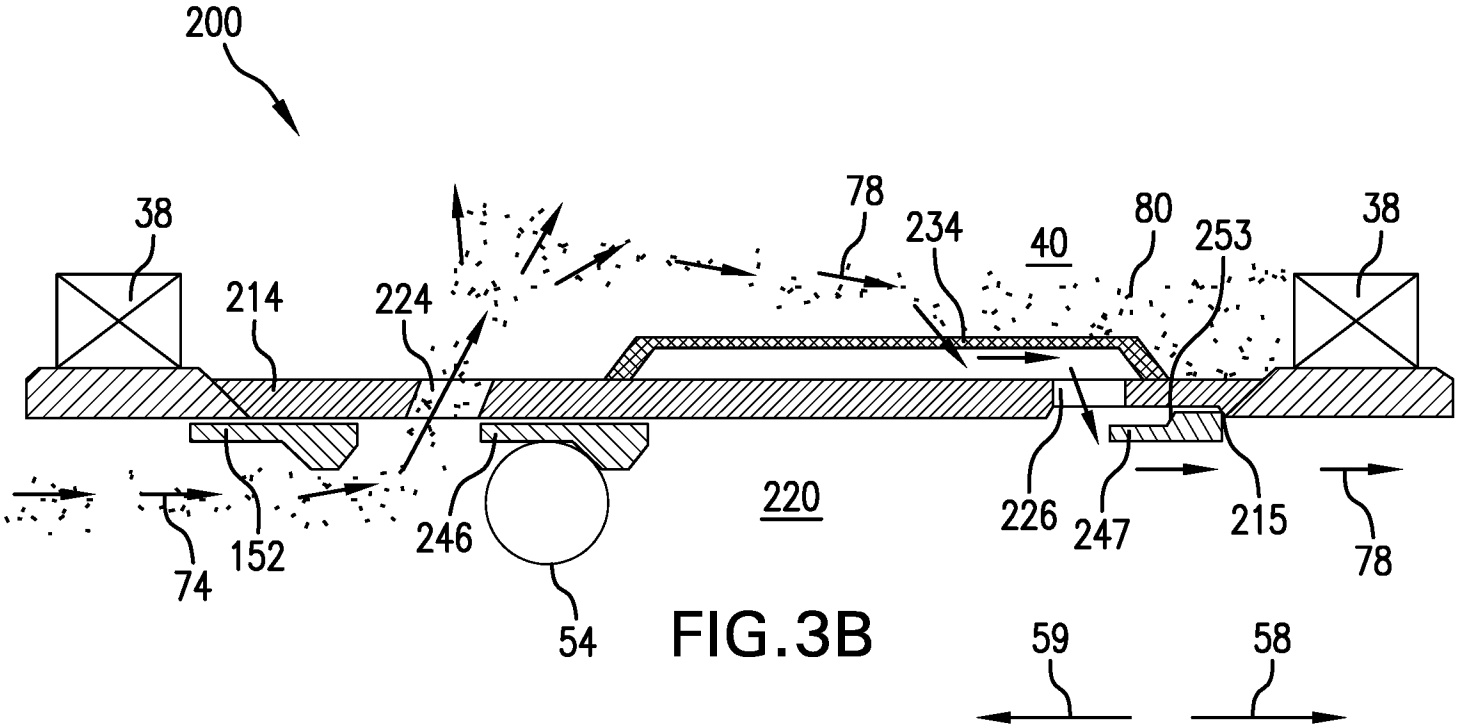

FIGS. 3A-3B show another embodiment of a frac and gravel packing system 200 where the return fluids 78 are directed in the downhole direction 58. Instead of a first sleeve 246 opening both the frac port 224 and the production port 226, the first sleeve 246 just opens the frac port 224. Further, a second sleeve 247 is provided radially interior to the production port 226 and includes a biased differential piston area 253 facing the tubular 214. When the plug 54 is seated on the first sleeve 246 and frac pressure is applied to open the frac port 224, the frac fluid 74 exits into the annular region 40 and substantially simultaneously impacts the piston area 253 of the second sleeve 247 to move the second sleeve 247 in the downhole direction 58. The tubular 214 may include a shoulder 215 to limit the distance the second sleeve 247 travels. Movement of the second sleeve 247 in the downhole direction 58 opens the production port 226. Thus, as in the prior embodiments, the frac fluid 74 fractures the formation 32 and gravel, sand, and proppant 80 collects on the screen 234 while return fluids 78 pass through the screen 234 and into the production port 226. With the flowbore 220 still closed by the plug 54, the return fluids 78 are directed in the downhole direction 58. A third sleeve 152 may subsequently close the frac port 224 using a second plug 92 (FIG. 1D), and the plugs 54, 92 may be subsequently removed so that the gravel packed screen 234 and production port 226 can be employed for producing purposes.

In the embodiment of FIGS. 3A-3B, the production port 226 is hydraulically opened using annular pressure rather than mechanically opened. Since one sleeve does not open both ports, the screen 234 may be longer in this embodiment as compared to the previously described embodiments. It is normal to have frac pressure built up to 10,000 psi on top of the plug 54, and the pressure below the plug 54 is relatively significantly less than frac pressure, so the second sleeve 247 will open almost immediately after the first sleeve 246 is opened. The second sleeve 247 will not open prior to the first sleeve 246 because there is no significant pressure in the annular region 40 applied to the piston area 253 of the second sleeve 247 until the first sleeve 246 is opened.

Figure 4:
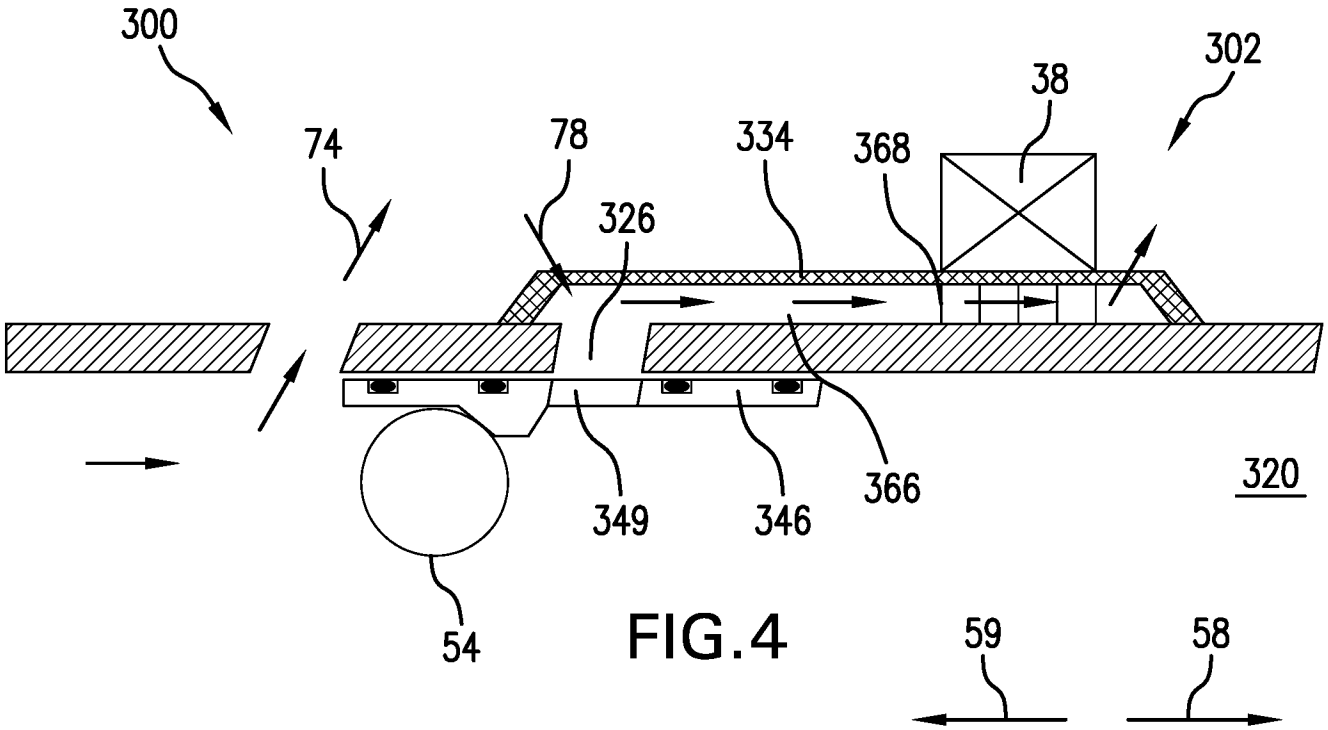
FIG. 4 depicts a schematic sectional views of a further embodiment of a frac and gravel packing system in which return fluids are directed to a downhole location; and, FIG. 5 depicts a schematic section view of another embodiment of a frac and gravel packing system in which return fluids are directed to surface.

FIG. 4 shows another embodiment of the frac and gravel packing system 300, which may use a first sleeve 346 that is similar to the first sleeve 146 shown in FIGS. 2A-2D. The screen 334 is fluidically connected to a return path 366 that extends in the downhole direction 58 from the screen 334, for routing return fluids 78 in the downhole direction 58. The first sleeve 346 may additionally include the aperture 349 for redundancy. That is, the return fluids 78 may travel either in the downhole direction 58 through the flowbore 320 or, if the flowbore 320 is blocked in the downhole direction 58 of the zone, such as by a plug in a lower zone, then the return fluids 78 are passable in the downhole direction 58 through the pathway 368 between the screen 334 to a location such as, but not limited to, dump zone 302. The dump zone 302 may be separated from adjacent zones by packers 38. Thus, system 300 shows redundancy, in that if the return path 366 is not possible down the flowbore 320 (such as if there is a lower plug or another obstruction in the flowbore 320 downhole of the zone 28), then the flowbore 320 can be bypassed using the pathway 368 as a portion of the return path 366. It is also possible for the return fluid 78 to pass through both the production port 326 and aperture 349 as well as the pathway 368.

Figure 5:
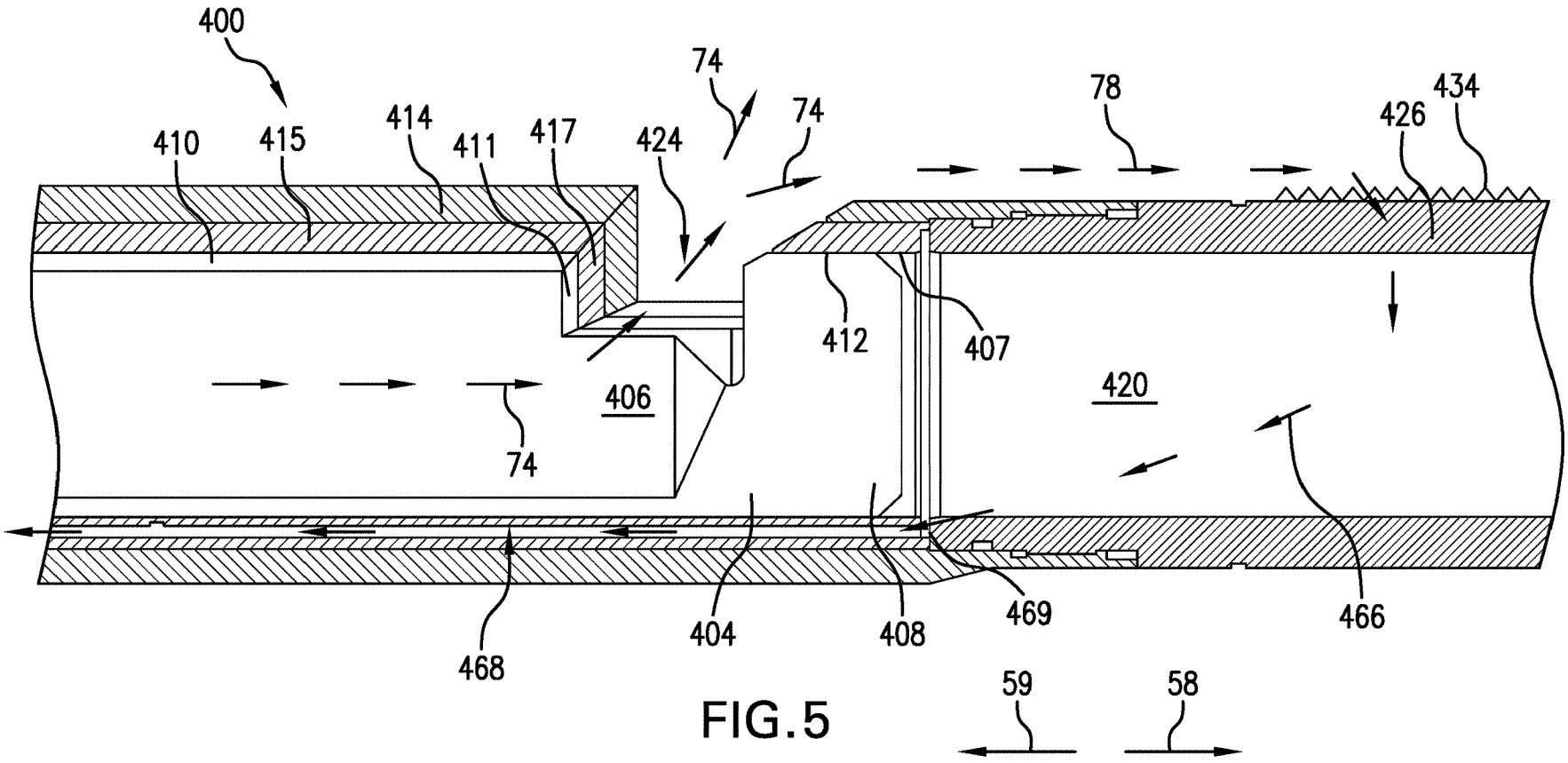

FIG. 5 shows another system 400 enabling a method for returning return fluids 78 to surface, using a longitudinally shiftable tool 404. The tool 404 includes a flowbore 406 that may be in fluidic communication with the flowbore 420 when the tool 404 is not blocked (such as by a plug, not shown, seated at the downhole end 408 of the tool 404). The tool 404 further includes a tubular wall 410. A radial port 411 interrupts the tubular wall 410. The tool 404 may further include a seal feature 407, such as, but not limited to, bonded rubber, along an exterior surface at the downhole end 408 of the tool 404. In a closed condition of the system 400, the frac port 424 in the tubular 414 is radially blocked by a frac sleeve, as will be further described below, and/or an imperforate downhole portion 412 of the wall 410. In an open condition of the tool 404 as shown, the tool 404 is blocked at the downhole end 408, such as by a plug, and moved in the downhole direction 58 to longitudinally align the radial port 411 in the tool 404 with the frac port 424. Movement of the tool 404 can further serve to open the frac sleeve so that frac fluid (slurry) 74 can be used to fracture the formation 32 as shown. Thus, the tool 404 may serve as part of a sleeve system to cover and uncover the frac port 424 in the closed and open conditions, respectively. The return fluid 78 will move along return path 466 by first passing through the screen 434, production port 426, and then into the flowbore 420. The return path 466 is further formed by a longitudinal pathway 468 extending longitudinally through the wall 410 of the tubular 414, or alternatively through a tubular 415 positioned radially interior to the tubular 414. The tubular 415 may concentrically surround the tool 404, or may be placed at a peripheral location within the interior of the tubular 414. Access 469 provides an entrance to the longitudinal pathway 468. As the tool 404 is blocked at the downhole end 408, the return fluid 78 will pass into the longitudinal pathway 468 to return to surface. As in the previous embodiments, a gravel pack will form at the screen 434. After completion of a fracturing and gravel packing operation, the tool 404 can be taken to a different position at a different zone, or alternatively can be taken back to surface for cleaning out if necessary. The tubular 415, or another portion of the system 400, includes the frac sleeve that re-closes the frac port 424 as the tool 404 is pulled in the uphole direction 59. The tubular 415 can include a radial port 417 that is also alignable with the frac port 424 of tubular 414.

In embodiments of the system 400, the tubular 415 (with frac sleeve) and screen 434 would have flow areas to allow for returns. The tool 404 could include a valve to provide the ability to switch from squeeze and circulate during treating. The tool 404 may further have the ability to provide set-down and upstrain indication. Upon reaching the appropriate frac port 424, the tool 404 could be sat down, opening the frac sleeve and, in alternative embodiments, additionally closing a flapper or "turning on" a ball seat at the downhole end 408. However, before turning on such a ball seat to be used during the fracturing operation, a plug such as a ball or dart could be pumped down to open a monitoring or sliding sleeve valve. This would allow fluid and proppant to reach the bottom of the zone during the fracturing operation. The ball seat could be a collet or dog style. Once the seat has been "turned on", a plug such as a ball/dart could be pumped down and land on the seat, or alternative devices for enabling a blocked downhole end 408 may be utilized. Fracking operations can then be performed, and once complete, the frac sleeve could be closed and the ball seat "turned off" At this point depending on what the ball is made of and how it holds up, the ball may be retrieved and taken to the next zone to repeat the process. For example, once the ball seat has been turned off and sliding sleeve closed, the ball used during fracturing could by pumped down to close an additional sleeve. This sleeve could have been opened (by ball or mechanically) before the fracturing operation to allow fluid and proppant to reach the bottom of the zone before returning to surface. Thus, in one embodiment, the system 400 enables a method where the tool 404 can shift a frac sleeve open, allowing a ball seat to "activate" to accept a ball, while simultaneously exposing the access 469 allowing for returns. A ball can then be dropped and the well fracked. Once fracking is complete, the tool 404 can shift the frac sleeve closed and allow the ball seat to deactivate. The tool 404 can then be picked up to a position to be reversed out and then moved to the next zone to have the process repeat. It should be understood that the system 400 does not necessarily need to use a ball for the system 400 to function, as alternative devices to close the downhole end 408 may be utilized. Tool 404, tubular 415, and tubular 414 each include ports 411, 417, 424 that are alignable, so that as slurry/or frac fluid 74 is pumped through frac port 424, fluid 78 from the slurry 74 enters screen 434 and makes its way to longitudinal pathway 468. The longitudinal pathway 468 could deliver returns through a packer and/or other features of a completion using the system 400. Alternatively, there could be an annular passage between the tubular watt 410 of tool 404 and tubular 415 that could take return fluids 78 back to surface. After a treatment is complete, the tool 404 can be retrieved, closing the tubular 415 by either axial or rotational motion.

The embodiments of a system described herein provides return paths 66, 166, 266, 366, 466 that provide the ability to complete a frac and gravel pack in a time efficient manner. While particular embodiments for the return paths have been shown, portions of the return paths may alternatively be provided by shunt tubes. While the sleeve system 44 has been disclosed as ball-activated, using the plugs, other types of sleeve activation may be incorporated, such as, but not limited to electronically triggered systems, however some embodiments of the systems described herein enable the completion of a frac and gravel pack using a ball drop system, which is an unconventional procedure and provides advantages of time savings and expense. In some of the embodiments of the systems described herein, the features of the systems for fracking, gravel packing, and production, (aside from the plugs) remain within the borehole 30 for operation, thus negating the need for insertion and removal of service tools. Additional mechanical intervention is not required for accessing the return path in each embodiment. There is no need to manipulate a work string using a tool to provide access to a return path, eliminating the need for a service tool assembly to interact with the sleeve, thus removing that interface. In some of the embodiments of the system, the system may be advantageously run in one trip and left in the well for the fracturing operation, the gravel packing operation, and for production. This could lead to substantially less complex multi-zone wells, not just in terms of the completion itself but also running and operating the system. Further, the return paths of the embodiments of the systems 10, 100, 200, 300, 400 may be provided to direct return fluids 78 to surface, in a downhole direction 58 to another zone through the flowbore 20 or to a dead zone 302, and thus the system is configurable depending on the needs of the customer and for the operation.

Set forth below are some embodiments of the foregoing disclosure:

Embodiment 1

A frac and gravel packing system includes: a tubular having a longitudinal axis, a wall defining an interior flowbore, a radial frac port and a radial production port extending through the wall in a first zone of an annular region surrounding the tubular; a screen surrounding the production port, the frac port not covered by the screen; a sleeve system including a sleeve longitudinally shiftable with respect to the longitudinal axis of the tubular, the sleeve configured to cover the frac port in a first position of the sleeve and uncover the frac port in a second position of the sleeve; and, a return path arranged to permit return fluid from a fracturing operation to exit the first zone of the annular region, wherein the return fluid passes through the screen prior to accessing the return path.

Embodiment 2

The frac and gravel packing system of any of the preceding embodiments, wherein the return path is configured to direct return fluid in an uphole direction.

Embodiment 3

The frac and gravel packing system of any of the preceding embodiments, wherein the return path is formed at least partially by a longitudinal pathway through the wall of the tubular.

Embodiment 4

The frac and gravel packing system of any of the preceding embodiments, wherein the sleeve is a first sleeve, and the sleeve system further includes a second sleeve, the return path formed at least partially by the second sleeve, and longitudinal movement of the second sleeve to re-cover the frac port interrupts the return path in the first zone.

Embodiment 5

The frac and gravel packing system of any of the preceding embodiments, wherein the sleeve includes an aperture, and the return path includes a radial access to the longitudinal pathway, and the sleeve blocks the radial access in the first position of the sleeve and unblocks the radial access in the second position of the sleeve.

Embodiment 6

The frac and gravel packing system of any of the preceding embodiments, wherein the return path is configured to direct return fluid in a downhole direction.

Embodiment 7

The frac and gravel packing system of any of the preceding embodiments, wherein the return fluid is directed through the production port and into the flowbore.

Embodiment 8

The frac and gravel packing system of any of the preceding embodiments, wherein the return fluid is directed through a space between the screen and the tubular to a location outside of the first zone.

Embodiment 9

The frac and gravel packing system of any of the preceding embodiments, wherein the sleeve is a first sleeve and additionally covers the production port in the first position of the first sleeve and uncovers the production port in the second position of the first sleeve, the sleeve system further including a second sleeve, and longitudinal movement of the second sleeve re-covers the frac port in a third condition.

Embodiment 10

The frac and gravel packing system of any of the preceding embodiments, wherein the first sleeve includes an aperture, and alignment of the aperture and the production port in the second position of the first sleeve exposes the production port.

Embodiment 11

The frac and gravel packing system of any of the preceding embodiments, wherein the sleeve is a first sleeve and is positioned within the tubular, and the sleeve system further includes a second sleeve that blocks the production port in a first position of the second sleeve and exposes the production port in the second position of the second sleeve, the second sleeve disposed interiorly of the tubular.

Embodiment 12

The frac and gravel packing system of any of the preceding embodiments, wherein the second sleeve further including a piston area configured to receive frac pressure from the frac port to hydraulically move the second sleeve to the second position.

Embodiment 13

The frac and gravel packing system of any of the preceding embodiments, further comprising a third sleeve, and longitudinal movement of the third sleeve is configured to re-cover the frac port.

Embodiment 14

The frac and gravel packing system of any of the preceding embodiments, further comprising a tubular tool located concentrically within the tubular, the tool configured to shift the sleeve, the return path disposed radially exterior of the tool.

Embodiment 15

A method of fracturing a formation and gravel packing a screen, the method including: actuating a sleeve to reveal a radial frac port in a tubular; revealing a radial production port in the tubular; fracturing a formation in a first zone through the frac port with fracturing fluid; packing a screen surrounding the production port with particulates from the fracturing fluid and the formation; passing return fluids from the fracturing fluid through the screen; and, sending the return fluids through a return path to a location uphole or downhole of the first zone.

Embodiment 16

The method of any of the preceding embodiments, wherein, in a first position, the sleeve blocks the frac port and the production port, and, in a second position of the sleeve, the sleeve substantially simultaneously uncovers the frac port and the production port.

Embodiment 17

The method of any of the preceding embodiments, wherein sending the return fluids through the return path includes passing the return fluids in an uphole direction through a longitudinal pathway at least partially formed in a wall of the tubular.

Embodiment 18

The method of any of the preceding embodiments, wherein the sleeve is a first sleeve, and further comprising substantially simultaneously re-covering the frac port and interrupting the return path with a second sleeve.

Embodiment 19

The method of any of the preceding embodiments, wherein sending the return fluids through the return path includes passing the return fluids in a downhole direction through the flowbore.

Embodiment 20

The method of any of the preceding embodiments, wherein sending the return fluids through the return path includes directing return fluids in a downhole direction through a space between the screen and the tubular to a location outside of the first zone.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frac and gravel packing system comprising:

a tubular having a longitudinal axis, a wall defining an interior flowbore, a radial frac port and a radial production port extending through the wall in a first zone of an annular region surrounding the tubular;

a screen surrounding the production port, the frac port not covered by the screen;

a sleeve system including a sleeve longitudinally shiftable with respect to the longitudinal axis of the tubular, the sleeve configured to cover the frac port in a first position of the sleeve and uncover the frac port in a second position of the sleeve;

a plug configured to land on the sleeve and block the flowbore, the plug and the sleeve shiftable together from the first position to the second position upon receipt of frac pressure for a fracturing operation; and, a return path arranged to permit return fluid from the fracturing operation to exit the first zone of the annular region, wherein the return fluid passes through the screen prior to accessing the return path, the return fluid prevented from moving within the flowbore in an uphole direction by the plug during the fracturing operation;

wherein a gravel pack is formed on the screen as a result of the fracturing operation.

2. The frac and gravel packing system of claim 1, wherein the return path is configured to direct return fluid in an uphole direction.

3. The frac and gravel packing system of claim 2, wherein the return path is formed at least partially by a longitudinal pathway through the wall of the tubular.

4. The frac and gravel packing system of claim 3, wherein the sleeve is a first sleeve and the plug is a first plug, the sleeve system further including a second sleeve configured to receive a second plug thereon, the return path formed at least partially by the second sleeve, and longitudinal movement of the second sleeve to re-cover the frac port interrupts the return path in the first zone.

5. The frac and gravel packing system of claim 3, wherein the sleeve includes an aperture, and the return path includes a radial access to the longitudinal pathway, and the sleeve blocks the radial access in the first position of the sleeve and unblocks the radial access in the second position of the sleeve when the aperture is aligned with the radial access.

6. The frac and gravel packing system of claim 1, wherein the return path is configured to direct return fluid in a downhole direction.

7. The frac and gravel packing system of claim 6, wherein the return fluid is directed through the production port and into the flowbore in the downhole direction, the flowbore blocked in an uphole direction by the plug.

8. The frac and gravel packing system of claim 6, wherein the return fluid is directed through a space between the screen and the tubular to a location outside of the first zone and in the downhole direction.

9. The frac and gravel packing system of claim 1, wherein the sleeve is a first sleeve and additionally covers the production port in the first position of the first sleeve and uncovers the production port in the second position of the first sleeve, the sleeve system further including a second sleeve, and longitudinal movement of the second sleeve re-covers the frac port in a third condition.

10. The frac and gravel packing system of claim 9, wherein the first sleeve includes an aperture, and alignment of the aperture and the production port in the second position of the first sleeve exposes the production port.

11. The frac and gravel packing system of claim 1, wherein the sleeve is a first sleeve and is positioned within the tubular, and the sleeve system further includes a second sleeve that blocks the production port in a first position of the second sleeve and exposes the production port in the second position of the second sleeve, the second sleeve disposed interiorly of the tubular.

12. The frac and gravel packing system of claim 11, wherein the second sleeve further includes a piston area configured to receive frac pressure from the frac port to hydraulically move the second sleeve to the second position.

13. The frac and gravel packing system of claim 11, further comprising a third sleeve, and longitudinal movement of the third sleeve is configured to re-cover the frac port.

14. A frac and gravel packing system comprising:

a tubular having a longitudinal axis, a wall defining an interior flowbore, a radial frac port and a radial production port extending through the wall in a first zone of an annular region surrounding the tubular;

a screen surrounding the production port, the frac port not covered by the screen;

a sleeve system including a sleeve longitudinally shiftable with respect to the longitudinal axis of the tubular, the sleeve configured to cover the frac port in a first position of the sleeve and uncover the frac port in a second position of the sleeve;

a tubular tool located concentrically within the tubular, the tool configured to be blocked at a downhole end of the tool by a plug to shift the sleeve; and a return path arranged to permit return fluid from a fracturing operation to exit the first zone of the annular region, the return path disposed radially exterior of the tool, the return fluid passing through the screen prior to accessing the return path, and the return fluid prevented from moving within the flowbore in an uphole direction by the plug during the fracturing operation;

wherein a gravel pack is formed on the screen as a result of the fracturing operation.

15. A method of fracturing a formation and gravel packing a screen, the method comprising:

blocking a flowbore of a tubular having a radially inner facing wall with a plug;

actuating a sleeve supported at the radially inner facing wall to reveal a radial frac port extending through an interior surface of the radially inner facing wall of the tubular using frac pressure within the flowbore;

revealing a radial production port extending through the interior surface of the radially inner facing wall of the tubular;

fracturing a formation in a first zone through the frac port with fracturing fluid;

packing a screen surrounding the production port with particulates from the fracturing fluid and the formation during the fracturing of the formation;

passing return fluids from the fracturing fluid through the screen; and, sending the return fluids through a return path to a location uphole or downhole of the first zone.

16. The method of claim 15, wherein, in a first position, the sleeve blocks the frac port and the production port, and, in a second position of the sleeve, the sleeve uncovers the frac port and the production port.

17. The method of claim 15, wherein sending the return fluids through the return path includes passing the return fluids in an uphole direction through a longitudinal pathway at least partially formed in the radially inner facing wall of the tubular.

18. The method of claim 17, wherein the sleeve is a first sleeve, and further comprising re-covering the frac port and interrupting the return path with a second sleeve.

19. The method of claim 15, wherein sending the return fluids through the return path includes passing the return fluids in a downhole direction through the flowbore.

20. The method of claim 15, wherein sending the return fluids through the return path includes directing return fluids in a downhole direction through a space between the screen and the tubular to a location outside of the first zone.

* * * * *